US010617219B2

(12) United States Patent
Lowe

(10) Patent No.: US 10,617,219 B2
(45) Date of Patent: Apr. 14, 2020

(54) ANCHORING APPARATUS FOR BEDCLOTHES

(71) Applicant: ELOWES LIMITED, Colchester Essex (GB)

(72) Inventor: Eric Lowe, Colchester (GB)

(73) Assignee: ELOWES LIMITED, Colchester (GB)

( * ) Notice: Subject to any disclaimer, the term of this patent is extended or adjusted under 35 U.S.C. 154(b) by 0 days.

(21) Appl. No.: 15/741,953

(22) PCT Filed: Jul. 8, 2016

(86) PCT No.: PCT/GB2016/052062
§ 371 (c)(1),
(2) Date: Jan. 4, 2018

(87) PCT Pub. No.: WO2017/009609
PCT Pub. Date: Jan. 19, 2017

(65) Prior Publication Data

US 2018/0192780 A1 Jul. 12, 2018

(30) Foreign Application Priority Data

Jul. 10, 2015 (GB) ..... 1512110.6

(51) Int. Cl.
*A47C 21/02* (2006.01)
*A44B 11/14* (2006.01)

(52) U.S. Cl.
CPC ..... *A47C 21/022* (2013.01); *A44B 11/14* (2013.01)

(58) Field of Classification Search
CPC ..... Y10T 24/23; Y10T 24/13; Y10T 24/318; Y10T 24/31; Y10T 24/3416; Y10T 24/3417; Y10T 24/3428; Y10T 24/3451; Y10T 24/3452; Y10T 24/3453; Y10T 24/3493; Y10T 24/44222; Y10T 24/44231; Y10T 24/44299; Y10T 24/44342; Y10T 24/44376; Y10T 24/44573; Y10T 24/44581; A47C 21/02; A47C 21/022;

(Continued)

(56) References Cited

U.S. PATENT DOCUMENTS 202,704 A * 4/1878 Clark et al. ..... F16M 13/02 24/523
1,514,440 A * 11/1924 Cram ..... A41F 11/02 24/499

(Continued)

FOREIGN PATENT DOCUMENTS

| | | |
|---|---|---|
| CN | 201658067 | 2/2010 |
| GB | 2477950 | 8/2011 |
| JP | 2006129997 | 5/2006 |

*Primary Examiner* — Jack W Lavinder
(74) *Attorney, Agent, or Firm* — Renner Kenner Greive Bobak Taylor & Weber

(57) ABSTRACT

Anchoring apparatus for a bed cover, comprising a base member (10) and a holding member (12, 120), wherein said base member (10) is configured to be affixed to a bed at a lower edge of a mattress (16) and includes a first portion (18) of a clip member, and said holding member (12, 120) comprises a second part of said clip member for enabling said base member (10) and said holding member (12, 120) to be releasably connected together, in use, said holding member further comprising a clamp member for releasably clamping a portion of said bed cover therein.

18 Claims, 8 Drawing Sheets

(58) Field of Classification Search
CPC ..... A45F 5/02; F16B 2/06; F16B 2/10; F16B 2/12; F16B 2/18; F16B 2/185; F16B 45/02; F16B 45/06; F16B 45/00
See application file for complete search history.

(56) References Cited

U.S. PATENT DOCUMENTS

| | | | | | |
|---|---|---|---|---|---|
| 2,014,478 | A * | 9/1935 | Luetteke | A47D 15/008 | 128/846 |
| 2,299,371 | A * | 10/1942 | Allen | A47D 15/02 | 24/499 |
| 4,541,137 | A * | 9/1985 | Murray | A47C 21/022 | 24/72.5 |
| 4,782,543 | A * | 11/1988 | Hutton | A47C 21/022 | 24/72.5 |
| 6,295,670 | B1 | 10/2001 | Schieberl | | |
| 6,490,768 | B1 | 12/2002 | Goodall | | |
| 2006/0000061 | A1 * | 1/2006 | Ota | A47C 21/022 | 24/72.5 |

* cited by examiner

ANCHORING APPARATUS FOR BEDCLOTHES

This invention relates generally to anchoring apparatus for bedclothes and, more particularly, to apparatus configured to hold bedclothes or bed coverings, such as top sheets, blankets, bed spreads and duvets, in place on a bed while the bed is slept in.

A number of devices have been proposed for anchoring or retaining a bed cover on a bed whilst it is in use, to prevent it from being pulled or falling off the bed during the night. One such device is described in U.S. Pat. No. 5,404,602, which comprises an integral clamp which extends from beneath the mattress, over the edge of the bed cover and is secured at the upper surface of the bed cover. There are, however, a number of drawbacks associated with this arrangement. Firstly, the device has to be completely removed in order to release the bed cover. Secondly, the device is bulky and unattractive when in use. Still further, the device anchors the bed cover tightly to the bed, with no means for adjustment to allow for some 'play' in the bed cover, to improve user comfort. Still further, additional straps extending across the upper surface of the mattress are required in order to secure the clamps to the bed.

It is an object of aspects of the present invention to address at least some of these issues and, in accordance with an aspect of the present invention, there is provided anchoring apparatus for a bed cover, comprising a base member and a holding member, wherein said base member is configured to be affixed to a bed at a lower edge of a mattress and includes a first portion of a clip member, and said holding member comprises a second part of said clip member for enabling said base member and said holding member to be releasably connected together, in use, said holding member further comprising a clamp member for releasably clamping a portion of said bed cover therein.

In an exemplary embodiment, the clamp member may comprise a rear grip member and a hooked portion in opposed, spaced-apart relation, communicably coupled together by means of an over-centre pivot mechanism and configured to be manually operated between a first, open configuration in which an opening is defined between said hooked portion and said rear grip member into which said portion of said bed cover can be inserted, and a second, closed configuration, in which said portion of said bed cover is clamped between said hooked portion and said rear grip member.

In an exemplary embodiment, the holding member comprises means for enabling selective adjustment of a distance between said rear grip member and said hooked portion defining said opening. Such adjustment means may comprise one or more spring members, biased either toward or away from said opening.

The above-mentioned rear grip member may, in one exemplary embodiment, comprise an end portion that is slidably mounted relative to said hooked portion and selectively movable to alter the distance between it and said hooked portion. The end portion may be mounted within a channel defined in a housing member such that an end thereof, nearest said hooked portion, extends beyond a peripheral edge of said housing member. The end portion may be communicably coupled to said rear grip member (or the above-mentioned housing member) by one or more spring members operable to bias said end portion toward said hooked portion.

A cam member may be mounted or otherwise provided at an end of said end portion nearest said hooked portion. The cam member may be fixed (and, optionally, integrally formed with the end portion), or it may be mounted to said end portion for rotation about an axis extending substantially laterally relative to said end portion.

The holding member may further comprise a cover member, communicably coupled at an upper edge thereof to said hooked member. In this case, the cover member and said hooked portion may be communicably coupled by means that enable selective adjustment of the lateral distance between said hooked portion and said upper end of said cover member. Optionally, the adjustment means may comprise a spring member mounted between said hooked portion and said upper end of said cover member. The spring member may be an extension spring configured to bias said hook portion toward said upper end of said cover member.

The clip member may comprise a push button clip. In this case, the first portion of said clip member may comprise a male connector portion and said second portion of said clip member comprises a cooperative female connector portion of said push button clip. A release button for releasing said clip may be provided on a front portion of said cover member.

In an exemplary embodiment of the invention, the base portion may comprise a plate member configured to be placed under said mattress, in use. The plate member may be generally T-shaped, having a generally central leg and a substantially orthogonal cross-bar portion at a first end thereof. The first part of said clip member may be connected at a second, opposite end of said generally central leg. An upstanding end member may be provided at said second end of said generally central leg, and said first part of said clip member is connected to said end member. The first part of said clip member may be connected to said base member by means of a flexible connector. The length of said flexible connector may be adjustable. The connector may comprise webbing material.

In some exemplary embodiments, the plate member may include one or more mounting slots for receiving one or more additional clip members configured to anchor a bottom sheet, in use. At least a portion of a surface of said base member may include gripping means. The gripping means may comprise a plurality of raised ribs or bumps. In some cases, both opposing principal surfaces of said base member may include gripping means.

These and other aspects of the present invention will be apparent from the following specific description in which embodiments of the present invention are described, by way of examples only, and with reference to the accompanying drawings, in which.

Figure 1:
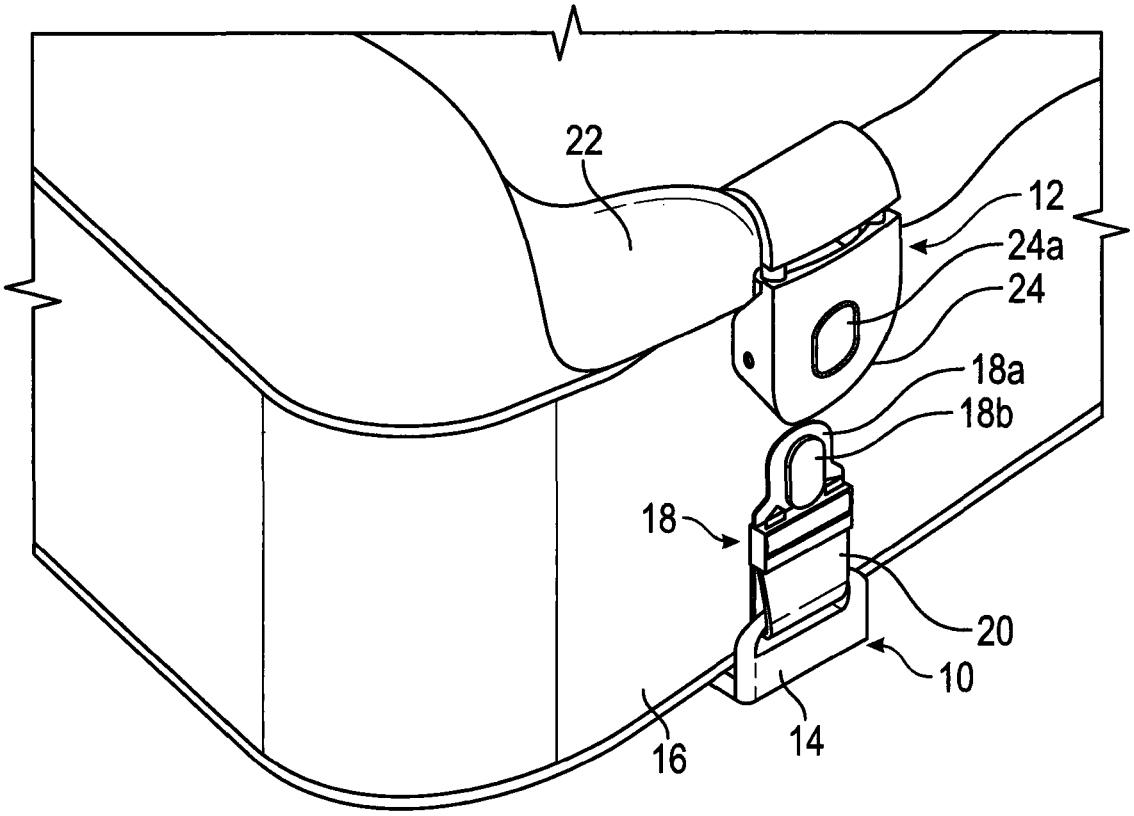
FIG. 1 is a schematic perspective view of an anchoring apparatus according to an exemplary embodiment of the present invention, in use and when in a released configuration.

Referring to FIG. 1 of the drawings, apparatus according to an exemplary embodiment of the present invention comprises a 'fixed' portion 10 and a releasable portion 12. The fixed portion 10 comprises a base 14, which is retained beneath a mattress 16, and has a first part 18 of a clip affixed thereto by means of a length of webbing 20. The releasable portion 12 is detachably affixed to the edge of a bed covering 22, such as a sheet, blanket, bedspread or duvet, and further includes a second part 24 of the above-mentioned clip. It can be seen from FIG. 1 that the first part 18 of the clip comprises the male portion of a front releasing button clip and the second part 24 comprises the corresponding female portion thereof. The first part 18 of the clip consists of an insert member 18*a* carrying a sprung button member 18*b*. The second part 24 defines a recess therein (not shown) that generally matches the shape and depth of the insert member 18*a*. In use, the insert member 18*a* is fully inserted into the recess of the second part 24 of the clip, such that the sprung button member is depressed and then springs back to exert a force against an internal retaining member. If it is required to release the clip, a user pushes the associated button 24*a* on the second member to depress the sprung button member 18*b* of the first part 18, releasing it from the internal retaining member and allowing the insert member 18*a* to be withdrawn from the recess. Such clips, and others, are well known in the art and will not be described in further detail herein.

Figure 2:
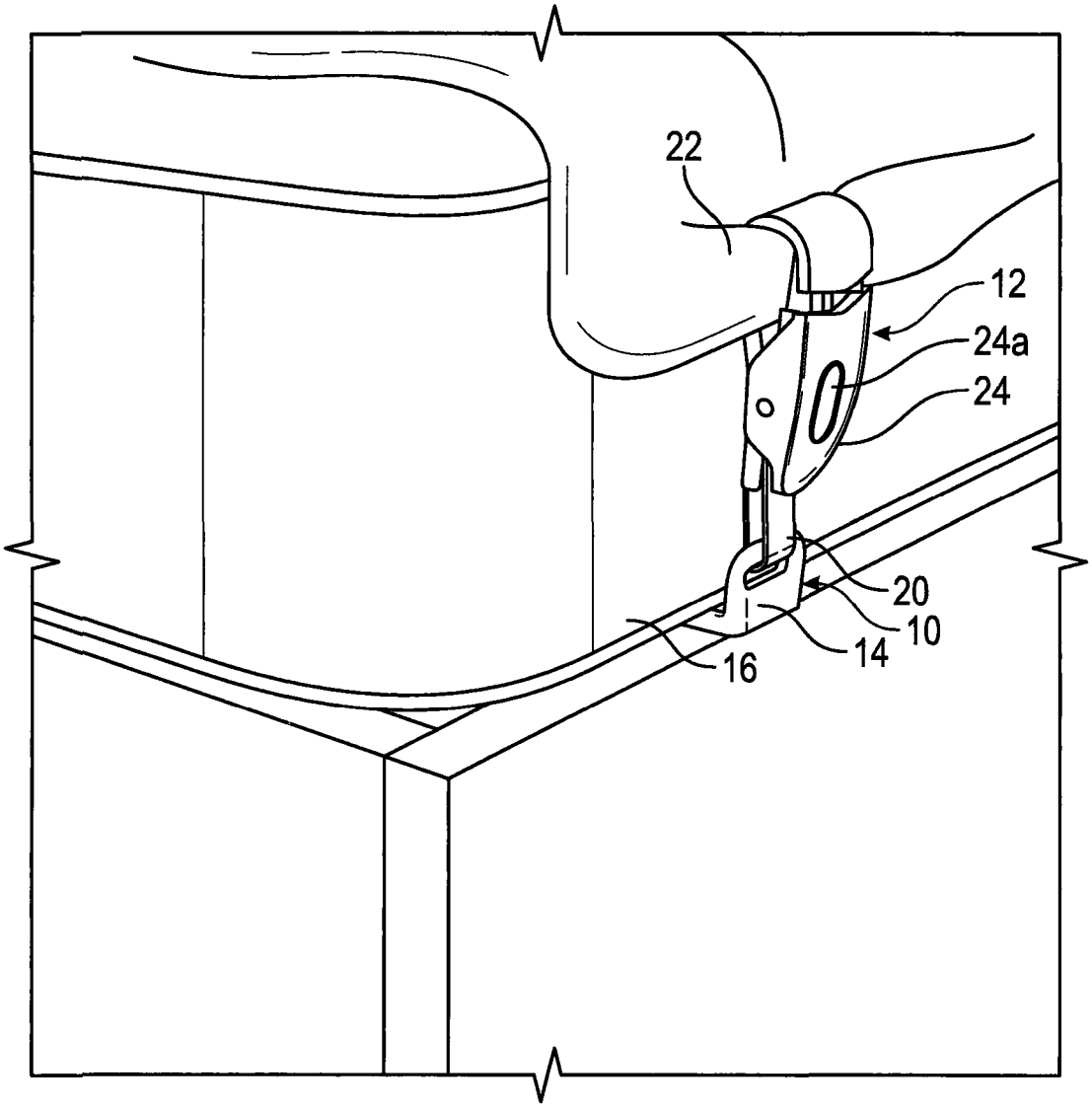
FIG. 2 is a schematic perspective view of the apparatus of FIG. 1, in use and when in a secured configuration.

Referring to FIGS. 1 and 2 of the drawings, in use, the fixed portion 10 of the apparatus, once installed with the base 14 underneath the mattress 16, remains in situ, whilst the releasable portion 12 can be selectively clipped thereto or released therefrom by means of the first and second parts 18, 24 of the clip, as described above. This means that the bed covering 22 can be selectively anchored to and released from the mattress 16, without the need to repeatedly attach and remove the apparatus to/from the bed. Thus, once configured, the apparatus can remain permanently in situ for repeated and selected use. As shown particularly in FIG. 2, when the two portions 10, 12 are clipped together, the bed covering is prevented from falling or being pulled off the mattress 16, when in use.

Figure 3A:
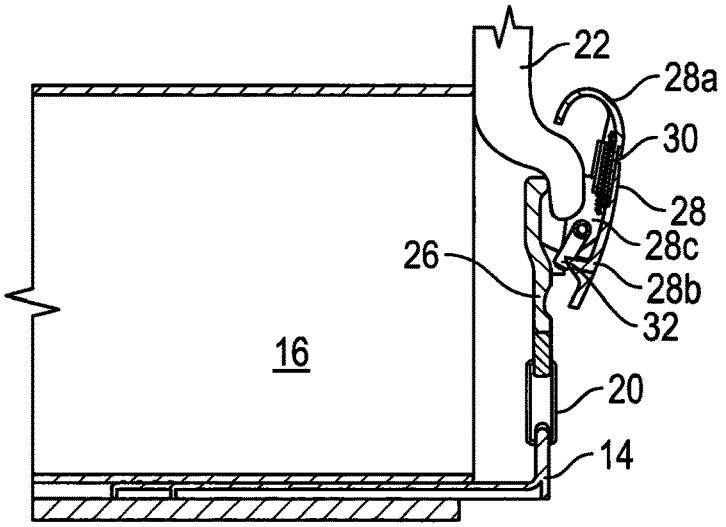
FIGS. 3A to 3C are schematic side cross sectional views illustrating the operation of a clamping system for use in anchoring apparatus according to an exemplary embodiment of the present invention.

Referring now to FIG. 3A of the drawings, the releasable portion 12 of the apparatus is provided with a clamp system for detachably affixing the releasable portion 12 to a bed covering 22. The clamp system comprises a rear grip member 26 and an overhead jaw member 28. The rear grip member 26 comprises an elongate plate which, in use, is oriented substantially vertically and parallel to the side edge of the mattress 16. The overhead jaw member 28 has an inverted, substantially J shaped cross-section, and consists of a lower, slightly curved facia 28*b*, in opposing and spaced apart arrangement relative to the rear grip member 26, and an upper hooked portion 28*a* which extends from the opt of the facia, and curves upwardly beyond and towards the inner surface of the rear grip member 26. The hooked portion 28*a* and the facia 28*b* are connected together with an extension spring 30 therebetween, such that the relative distance between the lower edge of the hooked portion 28*a* and the upper edge of the facia 28*b* can be adjusted, wherein, without any force being applied thereto, the extension spring 30 is configured to hold the above-mentioned edges of the hooked portion and facia together.

The rear grip member 26 and the facia 28 are together by means of a pivot mechanism 32, comprising an elongate arm which is pivotally mounted, at one end, to the rear grip member 26, and pivotally mounted, at the opposing end, to the facia 28 (via an inner mounting plate 28*c*). The pivot mechanism 32, so arranged and configured, forms an over-centre pivot in respect of the facia relative to the rear gripping member.

Figure 3B:
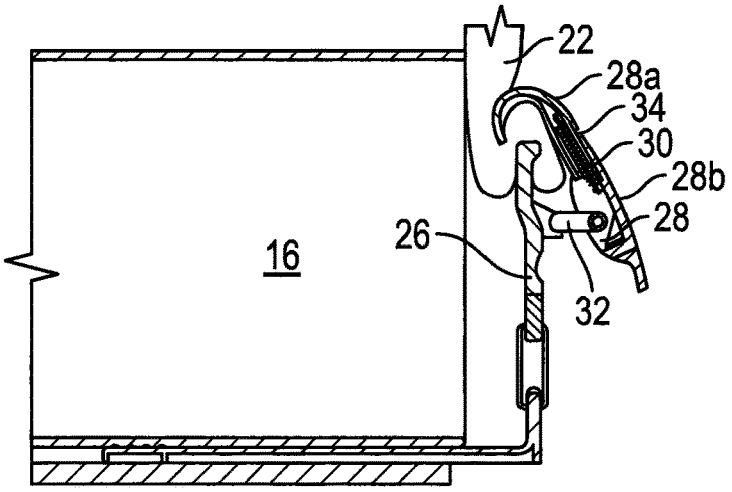
Figure 3C:
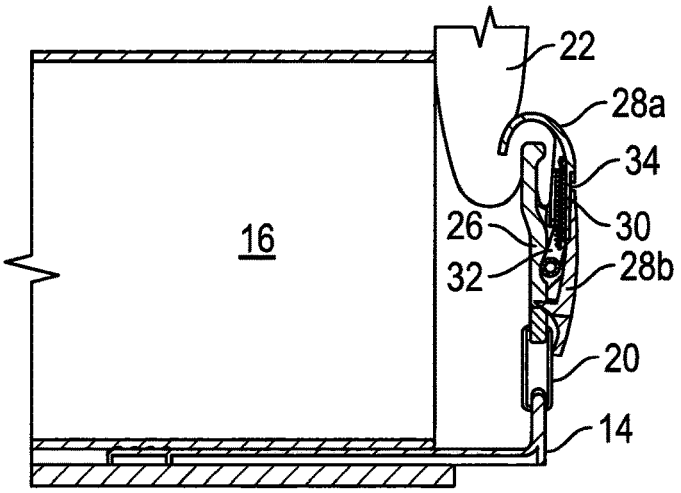

In use, and in an open configuration, an opening is defined between the inner surface of the hooked portion 28*a* of the spring-loaded jaw member and the upper edge of the rear grip member 26. A portion of the edge of a bed covering 22 is inserted into the clamp system via this opening. Next, and referring to FIGS. 3B and 3C of the drawings, a manual force is applied to the lower edge of the facia 28, so as to push it in the direction of the rear grip member 26. This action causes the facia to pivot about the respective adjacent end of the pivot mechanism arm. Simultaneously, the pivot mechanism arm is caused to pivot, in the same direction, at the opposite end. As the rear grip member 26 is effectively fixed, this causes a corresponding downward force to be applied to the facia (and hooked portion 28*a*) so that the hooked portion moves beyond the upper edge of the rear grip portion 26 (toward the mattress 16) and downward to close the gap between it and the upper edge of the rear grip portion 26 and apply clamping pressure to the bed cover edge located therebetween.

However, the extension spring 30 allows for a certain amount of height adjustment of the hooked portion 28*a* relative to the facia 28*b* (defined by the gap 34 therebetween), such that automatic adjustment of the gap between the inner surface of the hooked portion and the upper edge of the rear grip member 26 is effected to allow for varying thicknesses of bed covering. In the fully closed/clamped configuration, as illustrated in FIG. 3 of the drawings, the over-centred pivot mechanism 32 and the spring pressure lock the clamp system in place.

Figure 4B:
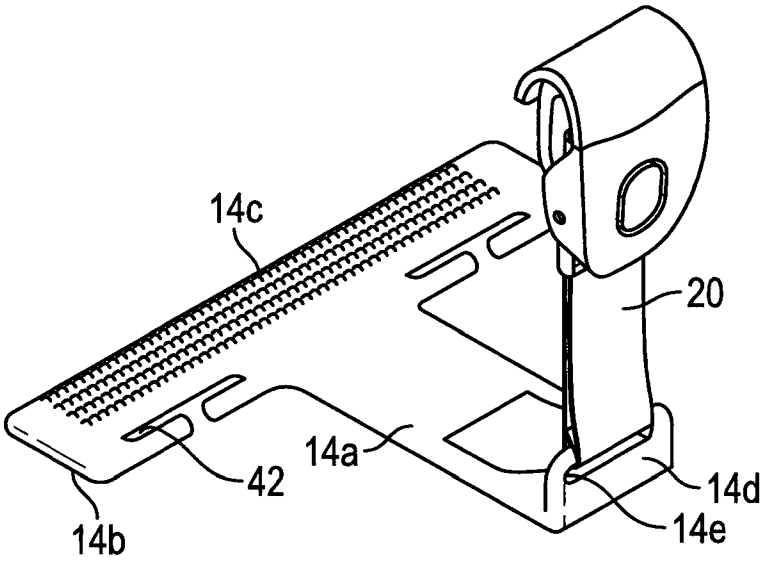
FIG. 4B is a schematic perspective view of the apparatus of FIG. 4A, illustrating the adjustable webbing feature.
Figure 4A:
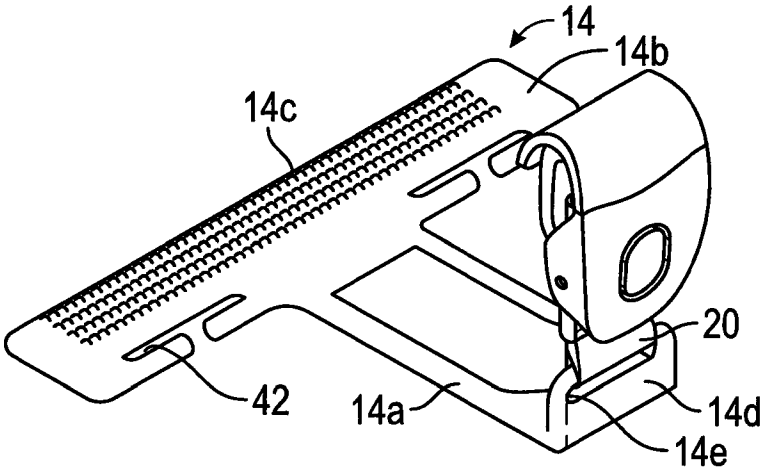
FIG. 4A is a schematic perspective view of an anchoring apparatus according to an exemplary embodiment of the present invention.

Referring now to FIGS. 4A and 4B of the drawings, the 'fixed' portion 10 of the apparatus comprises a generally T-shaped base 14 consisting of a central elongate leg 14*a* and a substantially orthogonal cross-bar portion 14*b*. The upper surface of the cross-bar portion 14*b* is provided with raised ribs or 'bumps' to form an area 14*c* of increased friction, such that when the base 14 is placed under a mattress, the frictional engagement between the base and the lower surface of the mattress is maximised. As the free end of the central leg 14*a*, i.e. the end furthest from the cross-bar portion 14*b*, there is provided an upstanding end member 14*d* having an opening 14*e* defined therein. As described with reference to FIG. 1 of the drawings, the first part 18 of the clip is affixed to the base 14 by means of a length of webbing 20 which is looped through the opening 14*e* in the end member 14*d*. Thus, one end of the webbing 20 is fixed to the first part 18 of the clip; the webbing extends through the opening 14*e*, is folded back on itself and the two opposing portions of the webbing are adjustably attached together in any known manner. The other end of the webbing is free. Thus, the two opposing portions of the webbing can be adjusted relative to each other, in any known manner, to adjust the resultant length of webbing 20 between the first part 18 of the clip and the end member 14*d* of the base 14. This allows for adjustment to take into account different thicknesses of mattress and also to enable a user to decide how much 'play' to allow in the bed covering, when anchored, according to personal preference and, of course, the extent to which the end of the bed covering extends down the side of the mattress.

Figure 5B:
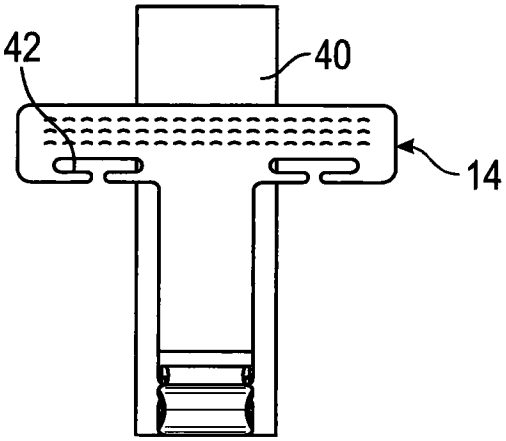
FIGS. 5A and 5B are schematic plan views of a base of anchoring apparatus according to an exemplary embodiment of the present invention, illustrating its use in relation to bed slats.
Figure 5A:
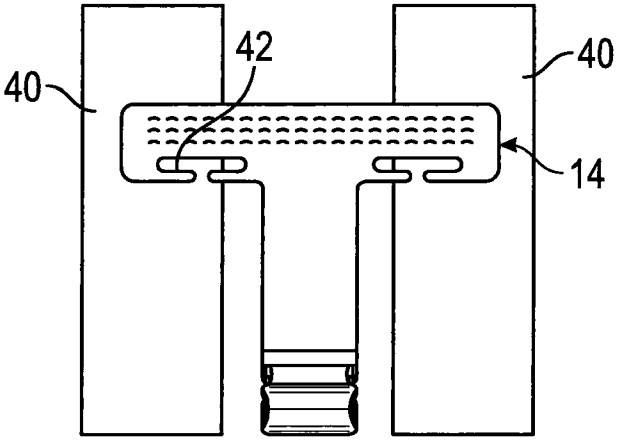

It can be seen from FIGS. 5A and 5B that the cross-bar portion 14*b* of the base 14 may be so dimensioned as to enable its effective use in different positions relative to bed slats 40. However, it will be appreciated that the present invention is not in any way intended to be limited for use with slatted bed frames, but is equally suitable for use with soft or solid mattress bases.

Figure 6:
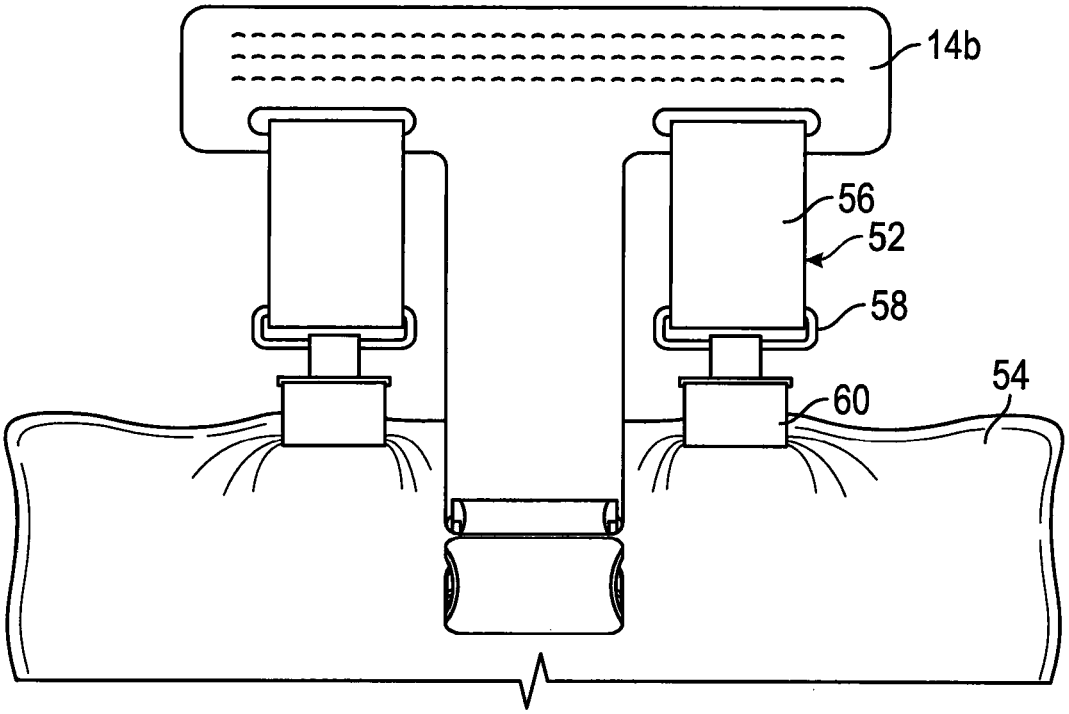
FIG. 6 is a schematic plan view illustrating an anchoring apparatus according to an exemplary embodiment of the present invention, including additional clips for securing a bottom sheet, in use.

Referring back to FIGS. 4A and 4B of the drawings, each overhanging edge of the cross-bar portion 14*b* of the base 14 is provided with an open slot 42. The slots 42 are provided to enable additional clips to be employed with the apparatus if required. Thus, referring to FIG. 6 of the drawings, one or more clip members 52 may be employed with the apparatus of an exemplary embodiment of the present invention to prevent the bottom sheet 54 from being pulled off in the night. Each illustrated clip member 52 comprises a length of looped webbing 56 having a folded portion at one end. The webbing 56 is affixed to the base 14 by inserting the loop formed by the folded portion of the webbing into a slot 42, via the opening, such that the open end portions thereof extend into the loop. At the opposite end of the webbing, there is provided a mounting ring 58 to which a clip 60, for example sprung or mechanical, is attached. It will be appreciated that one or more such clips may be selectively employed, as required, and the present invention is not intended to be in any way limited in this regard.

Figure 7A:
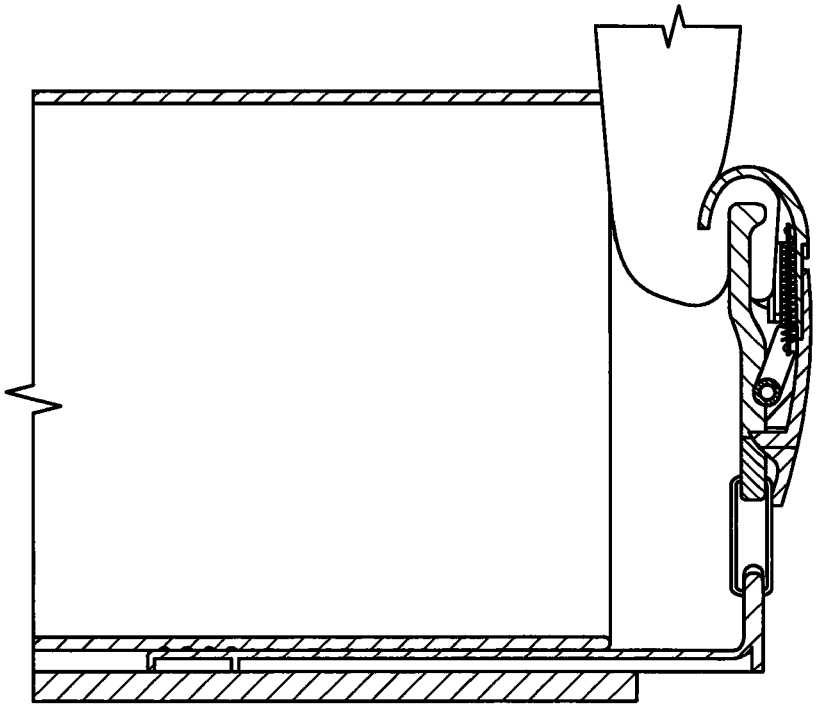
FIGS. 7A and 7B are schematic cross-sectional views of anchoring apparatus according to an exemplary embodiment of the present invention; illustrating the manner in which the base can be reversed to adjust the height of the overall mechanism.
Figure 7B:
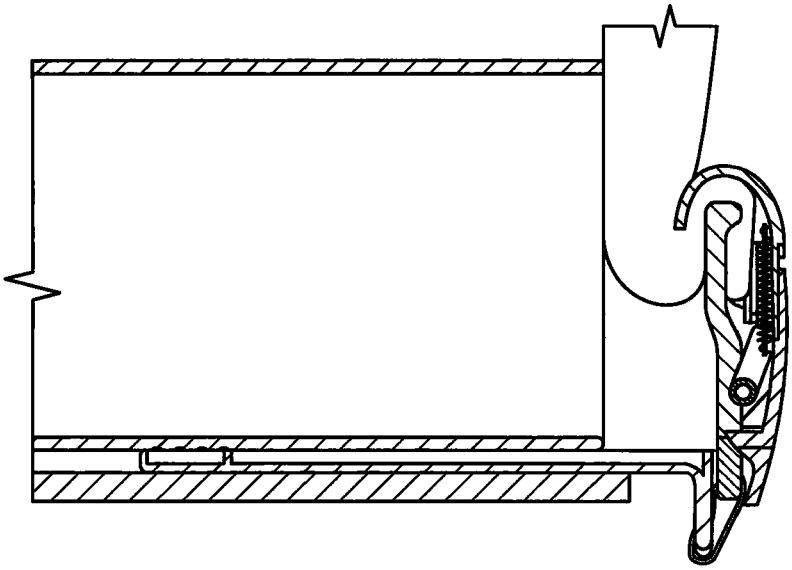

Referring to FIGS. 7A and 7B of the drawings, an additional advantage of the configuration of this exemplary embodiment of the present invention can be seen. Referring first to FIG. 7A of the drawings, in a first configuration, the base 14 is oriented such that the upstanding end member 14*d* projects upwardly, as in the previous examples. However, in FIG. 7B, it can be seen that the base 14 has been turned over, such that the end member 14*d* is projecting downwardly. The orientation of the clip part of the apparatus is corrected by inverting the webbing 20 and, as a result, the sitting height of the overall mechanism is significantly shortened for low mattresses, for example. In this case, a high friction/gripping area may be provided on both sides of the cross-bar portion of the base 14.

Figure 8:
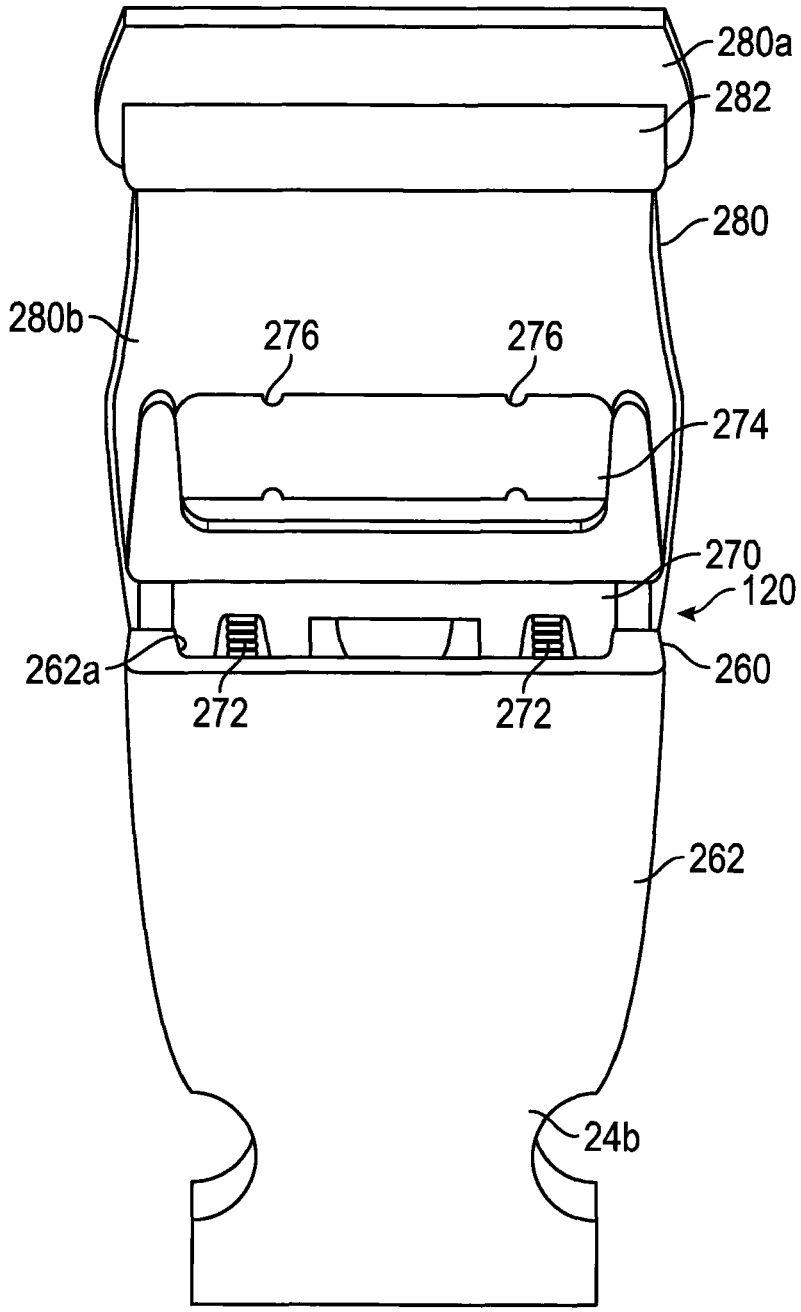
FIG. 8 is a schematic front view of a clamp system of anchoring apparatus according to another exemplary embodiment of the present invention.
Figure 9:
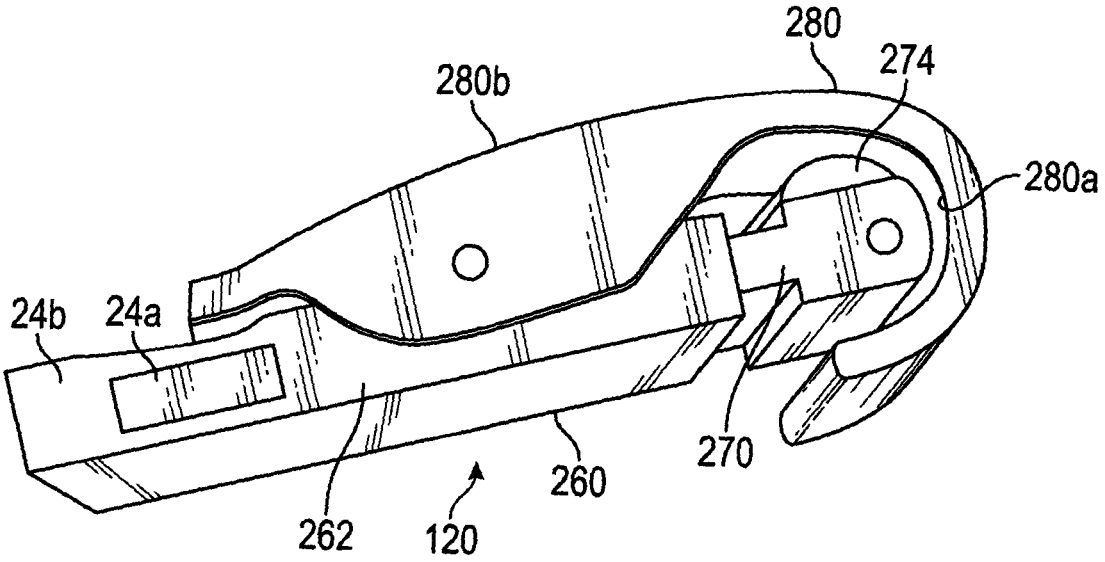
FIG. 9 is a schematic (partial) perspective side view of the clamp system of FIG. 8.

Referring to FIGS. 8 and 9 of the drawings, in an alternative exemplary embodiment of the present invention, the releasable portion 120 is once again provided with a clamp system for detachably fixing the releasable portion 120 to a bed covering. The clamp system comprises a body portion 260 and an overhead jaw member 280. The body portion 260 comprises an open ended housing 262 defining a receiving channel 262*a*. The overhead jaw member 280, once again, has an inverted, substantially J-shaped cross-section, and consists of a lower, slightly curved facia 280*b* and an integral upper hooked portion 280*a*. The jaw member 280 is pivotally mounted, at opposing side edges, to the housing 262, about a lateral axis thereof, such that the curved facia 280*b* of the jaw member 280 (at least partially) covers a front face of the housing 262 and the hooked portion 280*a* thereof, which extends from the top of the facia 280*b*, is oriented such that it curves generally over (and spaced-apart from) the open end of the housing 262. An end portion 270 is slidably mounted within the receiving channel 262*a* defined by the housing 262 such that an upper portion thereof extends beyond the upper peripheral edge of the housing 262 defining the channel 262*a*. The end portion 270 is coupled to the inner walls of the channel and upwardly biased therein (toward the open end thereof) by a pair of springs 272. The upper portion of the end portion 270 (extending beyond the peripheral edge of the housing 262) is provided with a cam member 274, which may be fixed or rotatably mounted, and extends laterally between side edges of the end portion 270. Indeed, the cam member 274 may even be integrally formed with the end portion 270. One or more grooves or ridges 276 may be formed in an outer surface of the cam member 274, wherein a rubber coating (or other frictional material) may be provided. The distal end of the hooked portion 280*a* of the jaw member 280 may also be provided with a rubber coating 282 (or other frictional material). Indeed, ridges may be provided on the inner surface of the hooked portion 280*a* and/or its distal end over which, optionally, a rubber (or other frictional) coating may be provided.

In use, as before, in an open configuration, an opening is defined between the distal end of the hooked portion 280*a* and the upper surface of the cam member 274. A portion of the edge of a bed covering is inserted into the clamp system via this opening. Next, a manual force is applied to the outer surface of the facia 280*b*, so as to push it towards the adjacent portion of the housing 262. This action causes the facia 280*b* to pivot relative to the housing 262. The configuration of the coupling between the jaw member 280 and the housing 262, with the pivot point toward a lower end of the facia 280*b* (i.e. off-centre and further from the hooked portion end than the opposing end), an over-centre locking mechanism is defined. Thus, when the upper part of the facia 280*b* is pivoted toward the housing 262, the jaw member 280 pivots over-centre and, in the fully closed configuration with no bed covering in situ (as shown in FIG. 9), the hooked portion 280*a* curves around the upper surface of the cam member 274 with its inner surface in very close proximity thereto. With a portion of bed covering in situ, the locking action will cause the bed covering to become 'trapped' or captured between the distal end/inner surface of the hooked portion 280*a* and the outer surface of the cam member 274 (with additional grip being provided by the optional rubber coating(s) thereon). The additional thickness of the bed covering between the hooked portion 280*a* and the cam member 274 causes the hooked portion 280*a* to generate a downward force (toward the housing 262), pushing the end portion 270 further into the channel 262*a* defined in the housing 262 (against the spring bias) by a distance corresponding to the thickness of the bed covering. The continued spring bias in the opposite direction to such movement of the end portion 270 (i.e. the spring bias in the direction toward the hooked portion 280*a*) maintains a strong grip on the bed covering between the cam member 274 and the distal end/inner surface of the hooked portion 280*a*. To release the bed covering, the user simply pivots the jaw member in the opposite direction, relative to the housing 262, to raise the hooked portion 280*a* away from the cam member 274 and release the gripping pressure on the bed covering. Thus, The upwardly biased springs 272, when the clamp system is in the closed configuration with a portion of bed covering between the hooked portion 280*a* and the cam member 274, maintain a grip therebetween on the bed covering by means o compression, which in one exemplary embodiment of the invention, can provide automatic adjustment (for various thicknesses of bed coverings) up to approximately 15 TOG.

In this exemplary embodiment, the base (not shown) may be connected to the clamp system by means of a conventional side release buckle/clip arrangement, wherein a resiliently flexible clip is provided on the base and a buckle 24*b* is provided at the 'lower' end of the clamp system. To connect the base to the clamp system, the clip is inserted into the buckle, such that a portion 24*a* of its side edges extends into a respective aperture in the buckle. In order to release the clip (and de-couple the base from the clamp system), a user depresses or "squeezes" the portions 24*a* of the clip, thereby releasing it and enabling it to be manually pulled out of the buckle.

Thus, aspects of the present invention provide a device for holding bedclothes on a bed, in use. The device is fully self-adjusting, allowing for varying thicknesses of bed covers to be equally effectively accommodated. 'All seasons' duvet assemblies that usually comprise two duvets releasably connected together for use during the winter months, can be accommodated without the need for a very large clamping system, simply by clamping only one of the duvets, in use. Furthermore, the amount of 'play' in the bed covering, when in use, is fully user selectable, simply by positioning of the device, and (automatic) adjustment of the relative height of the overall device. Any number of devices may be used, although it is envisaged that an equal number of devices will be used on each side of a bed, for example two on each side, but the present invention is not in any way intended to be limited in this regard. The device of aspects of the present invention has additional benefits when used to assist in removing a duvet from, or fitting a duvet to, a duvet cover. If it is required to remove a duvet from its cover, a user can attach a device one each side of the duvet/cover assembly, at the closed end of the duvet cover, clamping only the duvet cover, and simply pull the duvet itself from the open end. When fitting a cover to a duvet, a user again uses two devices at the closed end of the cover, feeds a first corner of the duvet into one corner of the cover and uses a device to clamp the duvet and cover at that corner. The user then feeds the second corner into the corresponding corner of the cover and clamps that corner. Finally, a user can simply pull the rest of the cover over the duvet and secure in the normal manner.

It will be appreciated by a person skilled in the art, from the foregoing description, that modifications and variations can be made to the described embodiments without departing from the scope of the invention as defined by the appended claims.

The invention claimed is:

1. Anchoring apparatus for a bed cover, comprising a base member and a holding member, wherein said base member is configured to be affixed to a bed at a lower edge of a mattress and includes a first portion of a clip member, and said holding member comprises a second part of said clip member for enabling said base member and said holding member to be releasably connected together, in use, said holding member further comprising a clamp member for releasably clamping a portion of said bed cover therein, wherein said clamp member comprises a rear grip member and a hooked portion in opposed, spaced-apart relation, communicably coupled together by means of an over-center pivot mechanism and configured to be manually operated between a first, open configuration in which an opening is defined between said hooked portion and said rear grip member into which said portion of said bed cover can be inserted, and a second, closed configuration in which said portion of said bed cover is clamped between said hooked portion and said rear grip member, wherein said holding member comprises means for enabling selective continuous adjustment of a distance between said rear grip member and said hooked portion defining said opening, and wherein said adjustment means comprises one or more spring members, biased either toward or away from said opening.

2. Apparatus according to claim 1, wherein said rear grip member comprises an end portion that is slidably mounted relative to said hooked portion and selectively movable to alter the distance between it and said hooked portion.

3. Apparatus according to claim 2, wherein a cam member is mounted or otherwise provided at an end of said end portion nearest said hooked portion.

4. Apparatus according to claim 3, wherein said cam member is fixed.

5. Apparatus according to claim 3, wherein said cam member is mounted to said end portion for rotation about an axis extending substantially laterally relative to said end portion.

6. Apparatus according to claim 1, wherein said clip member comprises a push button clip.

7. Apparatus according to claim 6, wherein said first portion of said clip member comprises a male connector portion and said second portion of said clip member comprises a cooperative female connector portion of said push button clip.

8. Apparatus according to claim 6, wherein said holding member further comprises a cover member, communicably coupled at an upper edge thereof to said hooked portion, wherein a release button for releasing said clip is provided on a front portion of said cover member.

9. Apparatus according to claim 1, wherein said base portion comprises a plate member configured to be placed under said mattress, in use.

10. Apparatus according to claim 9, wherein said plate member is generally T-shaped, having a generally central leg and a substantially orthogonal cross-bar portion at a first end thereof.

11. Anchoring apparatus for a bed cover, comprising a base member and a holding member, wherein said base member is configured to be affixed to a bed at a lower edge of a mattress and includes a first portion of a clip member, and said holding member comprises a second part of said clip member for enabling said base member and said holding member to be releasably connected together, in use, said holding member further comprising a clamp member for releasably clamping a portion of said bed cover therein, wherein said clamp member comprises a rear grip member and a hooked portion in opposed, spaced-apart relation, communicably coupled together by means of an over-center pivot mechanism and configured to be manually operated between a first, open configuration in which an opening is defined between said hooked portion and said rear grip member into which said portion of said bed cover can be inserted, and a second, closed configuration in which said portion of said bed cover is clamped between said hooked portion and said rear grip member, wherein said holding member comprises adjustment means for enabling selective continuous adjustment of a distance between said rear grip member and said hooked portion defining said opening, wherein said rear grip member comprises an end portion that is slidably mounted relative to said hooked portion and selectively movable to alter the distance between it and said hooked portion, and wherein said end portion is mounted within a channel defined in a housing member such that an end thereof, nearest said hooked portion, extends beyond a peripheral edge of said housing member.

12. Anchoring apparatus for a bed cover, comprising a base member and a holding member, wherein said base member is configured to be affixed to a bed at a lower edge of a mattress and includes a first portion of a clip member, and said holding member comprises a second part of said clip member for enabling said base member and said holding member to be releasably connected together, in use, said holding member further comprising a clamp member for releasably clamping a portion of said bed cover therein, wherein said clamp member comprises a rear grip member and a hooked portion in opposed, spaced-apart relation, communicably coupled together by means of an over-center pivot mechanism and configured to be manually operated between a first, open configuration in which an opening is defined between said hooked portion and said rear grip member into which said portion of said bed cover can be inserted, and a second, closed configuration in which said portion of said bed cover is clamped between said hooked portion and said rear grip member, wherein said holding member comprises adjustment means for enabling selective continuous adjustment of a distance between said rear grip member and said hooked portion defining said opening, wherein said rear grip member comprises an end portion that is slidably mounted relative to said hooked portion and selectively movable to alter the distance between it and said hooked portion, and wherein said holding member further comprises a cover member, communicably coupled at an upper edge thereof to said hooked portion.

13. Apparatus according to claim 12, wherein said cover member and said hooked portion are communicably coupled by adjustment means that enable selective adjustment of the lateral distance between said hooked portion and said upper edge of said cover member.

14. Apparatus according to claim 13, wherein said adjustment means comprises a spring member mounted between said hooked portion and said upper edge of said cover member.

15. Apparatus according to claim 14, wherein said spring member is an extension spring configured to bias said hook portion toward said upper edge of said cover member.

16. Apparatus according to claim 12, wherein said holding member comprises means for enabling selective adjustment of a distance between said rear grip member and said hooked portion defining said opening.

17. Apparatus according to claim 16, wherein said holding member comprises means for enabling selective continuous adjustment of a distance between said rear grip member and said hooked portion defining said opening.

18. Anchoring apparatus for a bed cover, comprising a base member and a holding member, wherein said base member is configured to be affixed to a bed at a lower edge of a mattress and includes a first portion of a clip member, and said holding member comprises a second part of said clip member for enabling said base member and said holding member to be releasably connected together, in use, said holding member further comprising a clamp member for releasably clamping a portion of said bed cover therein, wherein said clamp member comprises a rear grip member and a hooked portion in opposed, spaced-apart relation, communicably coupled together by means of an over-center pivot mechanism and configured to be manually operated between a first, open configuration in which an opening is defined between said hooked portion and said rear grip member into which said portion of said bed cover can be inserted, and a second, closed configuration in which said portion of said bed cover is clamped between said hooked portion and said rear grip member, wherein said holding member comprises adjustment means for enabling selective continuous adjustment of a distance between said rear grip member and said hooked portion defining said opening, wherein said rear grip member comprises an end portion that is slidably mounted relative to said hooked portion and selectively movable to alter the distance between it and said hooked portion, and wherein said end portion is communicably coupled to said rear grip member by one or more spring members operable to bias said end portion toward said hooked portion.

* * * * *